US007210406B2

(12) United States Patent
Schäfer et al.

(10) Patent No.: US 7,210,406 B2
(45) Date of Patent: May 1, 2007

(54) CYLINDER PAIR HAVING A PLURALITY OF PRINTING FORMES AND BLANKETS AND OFFSET GROOVE OPENINGS

(75) Inventors: Karl Robert Schäfer, Rimpar (DE); Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 201 days.

(21) Appl. No.: 10/517,770

(22) PCT Filed: Jun. 5, 2003

(86) PCT No.: PCT/DE03/01845

§ 371 (c)(1),
(2), (4) Date: Dec. 27, 2004

(87) PCT Pub. No.: WO2004/002739

PCT Pub. Date: Jan. 8, 2004

(65) Prior Publication Data

US 2005/0199147 A1 Sep. 15, 2005

(30) Foreign Application Priority Data

Jun. 26, 2002 (DE) ..... 102 28 968

(51) Int. Cl.
*B41F 27/12* (2006.01)
*B41F 30/04* (2006.01)

(52) U.S. Cl. ..... 101/375; 101/378; 101/415.1

(58) Field of Classification Search ..... 101/375, 101/376, 378, 415.1, 216, 217
See application file for complete search history.

(56) References Cited

U.S. PATENT DOCUMENTS

| | | | |
|---|---|---|---|
| 6,561,094 | B1 | 5/2003 | Schneider et al. |
| 6,920,824 | B2 | 7/2005 | Holm |
| 7,066,090 | B2 | 6/2006 | Holm |
| 2002/0178946 | A1 | 12/2002 | Hahn |
| 2002/0178947 | A1 | 12/2002 | Hahn |
| 2002/0189470 | A1 | 12/2002 | Holm |
| 2005/0145129 | A1 | 7/2005 | Holm |
| 2006/0117974 | A1 | 6/2006 | Holm |

FOREIGN PATENT DOCUMENTS

| | | | |
|---|---|---|---|
| CH | 345906 | | 6/1960 |
| DE | 2 220 652 | | 11/1973 |
| DE | 25 28 008 | | 1/1976 |
| DE | 198 54 495 | A1 | 9/1999 |
| DE | 696 04 065 | T2 | 4/2000 |
| DE | 199 24 786 | A1 | 12/2000 |
| DE | 199 61 574 | A1 | 7/2001 |
| DE | 100 66 162 | B4 | 8/2004 |
| GB | 1 476 707 | | 6/1977 |
| JP | 1007 1694 | A | 3/1998 |
| WO | WO 01/39977 | A1 | 6/2001 |

*Primary Examiner*—Leslie J. Evanisko
(74) *Attorney, Agent, or Firm*—Jones Tullar Cooper, PC

(57) ABSTRACT

A cylinder of a printing unit of a rotary offset printing machine has a periphery and an axial length. The peripheral surface of the cylinder is divided, in the axial length, into at least three sections that are positional next to one another. The peripheral surface has, in at least three sections, at least one slot-shaped opening. At least two of the sections each have two openings which are arranged offset with respect to each other about the periphery of the cylinder. The cylinder is intended for use in a cylinder pair including a 6/2 printing cylinder and an associated transfer cylinder.

20 Claims, 5 Drawing Sheets

CYLINDER PAIR HAVING A PLURALITY OF PRINTING FORMES AND BLANKETS AND OFFSET GROOVE OPENINGS

CROSS-REFERENCE TO RELATED APPLICATIONS

This U.S. patent application is the U.S. National Phase, under 35 USC 371, of PCT/DE2003/01845, filed Jun. 5, 2003; published as WO 2004/002739 A1 on Jan. 8, 2004, and claiming priority to DE 102 28 968.9, filed Jun. 26, 2002, the disclosures of which are expressly incorporated herein by reference.

FIELD OF THE INVENTION

The present invention is directed to a cylinder pair and to a cylinder of a printing group of a rotary offset printing press. The cylinder pair consists of a forme cylinder and a transfer cylinder.

BACKGROUND OF THE INVENTION

A printing group of a rotary printing press having at least one transfer cylinder and at least one forme cylinder is known from WO 01/39977 A1. The transfer cylinder has a groove for receiving either one or several printing blankets, and the forme cylinder has at least two grooves, which are arranged one behind the other in the circumferential direction, for receiving one or several printing formes. At least one of the grooves of the forme cylinder is at least partially covered by a printing forme. That at least partially covered groove of the forme cylinder rolls off on the area of the groove of the cooperating transfer cylinder intended for receiving one or several printing blankets. The ends of the printing formes can be arranged, offset with respect to each other, in different grooves, or the forme cylinder can have at least two printing formes arranged side-by-side in the axial direction, or can have several printing formes arranged one behind the other in the circumferential direction. In the case of several printing formes arranged over the entire circumference, these can also be arranged with their ends alternatingly arranged offset with respect to each other.

DE 22 20 652 A1 describes a device for fastening flexible printing plates on the plate cylinder of a rotary printing press. The device has a pair of bracing-clamping cheeks, which are arranged on the same shaft and which are arranged in a cylinder groove in the cylinder body, and are pivotable around a shaft that is extending parallel with the cylinder axis over the entire length of the cylinder. A bracing-clamping cheek pair consists of a bracing cheek and a clamping cheek, wherein the bracing cheek, as well as the clamping cheek working together with it, are seated, pivotable around a shaft which is parallel with the axis and which can be actuated from the front end of the cylinder. In the preferred embodiment described, four bracing-clamping cheek pairs are alternatingly arranged, once on one half of the cylinder length and again on the other half of the cylinder length. To adapt this prior device to printing plates of different format widths, a short bracing-clamping cheek pair is arranged as an extension element between two adjoining bracing-clamping cheek pairs in such a way that it can be connected in the cylinder body with the adjacent bracing-clamping cheek pairs and thus can be pivoted in the same way as the bracing-clamping cheek pairs. Two coaxially arranged connecting shafts are provided in each cylinder groove, which shafts can be rigidly connected with a bracing-clamping cheek pair, that is arranged in one half of the cylinder length, and which shafts permit a torque to be transmitted from the front end, which is a part of the other half of the cylinder, to the bracing-clamping cheek pair which is connected with the connecting shafts. Accordingly, the connecting shafts are pivotably seated in the cylinder groove in the same way as are the bracing-clamping cheek pair connected with them.

A cylinder pair of a rotary printing press, with a 6/2 plate cylinder and with a printing blanket cylinder, is known from DE 25 28 008 A1. A center set of printing plates is arranged on the plate cylinder and is deliberately offset, at an angle other than 90°, from the two outer sets of printing plates positioned at the ends of the plate cylinder. The center printing blanket on the printing blanket cylinder is arranged deliberately offset at an angle other than 90° from the outer sets of printing blankets at the ends of the blanket cylinder. The ends of the dressings which are not angled off and which rest on the respective cylinder, are held by holding devices which are movable in wide cylinder grooves. Ends of dressings, which ends face each other, form a gap between themselves, which gap extends over the width of these dressings.

A device for bracing and/or for clamping flexible plates with angled-off suspension legs, which legs project into a fastening slit of a cylinder used for supporting the plates, is known from DE 199 24 786 A1. The fastening slit is connected with an axis-parallel cylinder groove in the cylinder radial direction. A base body, which is open in the direction toward the fastening slit, is arranged in the cylinder groove. Movable bracing and/or clamping elements are provided in the interior of the base body. The base body can consist of several shorter base bodies, which can be coupled together. The base body or bodies, arranged in a row in the cylinder groove, are connected with each other, fixed against relative rotation, by, for example, a tooth arrangement. A first and a last base body are each connected, fixed against relative rotation, with an end coupling element, whose parts which cover the cylinder groove are fastened on the flanks of the cylinder, for example by the use of screws.

A cylinder of a web-fed rotary printing press is known from DE 199 01 574 A1. A shell of the cylinder is divided, over its length, into adjoining sections, and an opening is provided in each section. This type of construction of a cylinder is not suitable for use in arranging several dressings on the shell of the cylinder along its circumference.

Such a cylinder of single circumference is also known from JP 10-071 694 A. The forme cylinder and the transfer cylinder are arranged in the printing group in such a way that an opened section of the forme cylinder rolls off on a closed section of the transfer cylinder, and vice versa.

A printing group cylinder, with a groove with alternatingly opened and closed areas arranged on the shell, is known from DE 198 54 495 A1. Tongues of a printing forme to be mounted on the printing group cylinder extend into the opened areas.

A cylinder for printing presses is known from DE 696 04 065 T2. A groove, which is open toward the shell, is closed by an insertion piece, which terminates flush with the shell.

A cylinder of single circumference for printing presses is known from CH 345 906 A. Four dressings are arranged, side-by-side, on the cylinder in its axial direction. Each of the dressings is fastened in a bracing groove which is open toward the shell of the cylinder. The bracing grooves of adjacent dressings are arranged offset in respect to each other along the circumference of the cylinder.

SUMMARY OF THE INVENTION

The object of the present invention is directed to providing a cylinder pair, or to providing a cylinder of a printing group of a rotary offset printing press.

The object is attained in accordance with the invention by the provision of a cylinder pair of a printing group of a rotary offset printing press including a forme cylinder and a transfer cylinder. Both of these cylinders are divided, in their axial length, into sections and both cylinders are provided with axially extending, dressing end receiving grooves.

The advantages which are attainable in accordance with the present invention consist, in particular, in that openings in the shell of the cylinder are provided only where they are required for holding the dressings. This reduces the danger of a break of one of the dressings, in the course of these dressings rolling off against a cylinder against which they are placed. At the same time, the effects of the groove beat, generated by the cylinder grooves, are reduced by the offset arrangement of the grooves. These steps contribute to the provision of quiet running and of reduced vibrations, in particular in connection with cylinders of great length. These steps therefore also result in an improvement to the print quality. In sections of the grooves, which sections are closed against the shell of the cylinders, it is possible to arrange low-cost filler elements, without holding assemblies for the dressings, in a mounting-friendly manner. In this case, the filler elements can be produced in almost every desired length. Since through-bores, with the required accuracy, can be provided in cylinders of great length only at great expense, in one preferred embodiment variation of the present invention, the cylinders have at least one blind bore extending underneath an outer closed section in the axial direction of the cylinder.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENT

Figure 1:
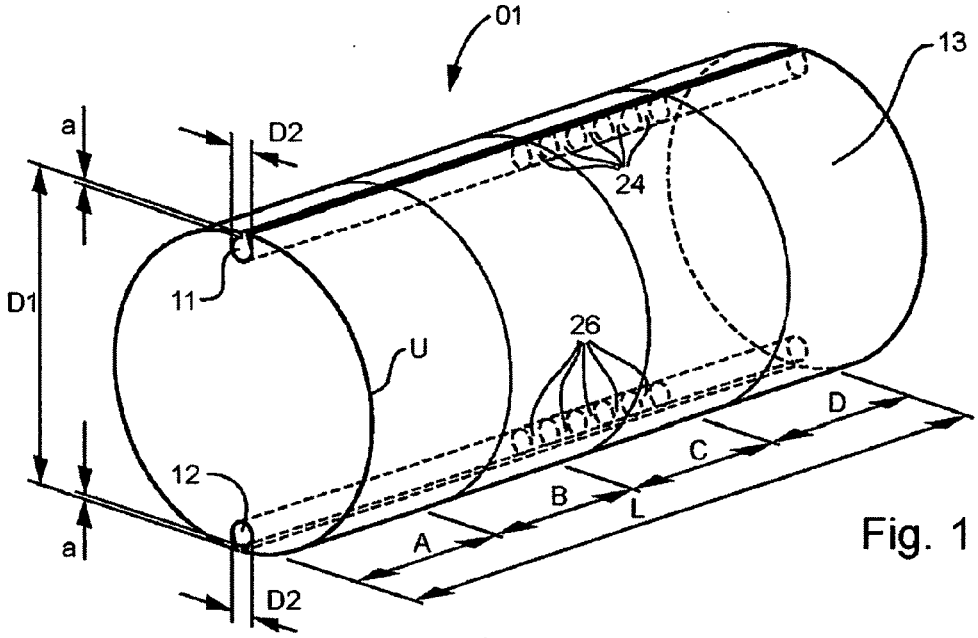
FIG. 1, a perspective plan view of a cylinder with two grooves and with four, side-by-side arranged, dressings in accordance with the present invention, in FIG. 2, a simplified schematic representation of a printing group with a 6/2 forme cylinder and a transfer cylinder, both of single circumference, in FIG. 3, a perspective plan view of a dressing, in FIG. 4, a partial sectional representation of a cylinder with a groove and with a device for fastening a dressing on a cylinder arranged in the groove, in FIG. 5, a planar projection of four dressings arranged side-by-side offset from each other on a cylinder, and in FIG. 6, a simplified perspective plan view of a base body or a filler element in accordance with the present invention; and in FIG. 7 is a simplified side elevation view of a satellite printing group.
Figure 5:
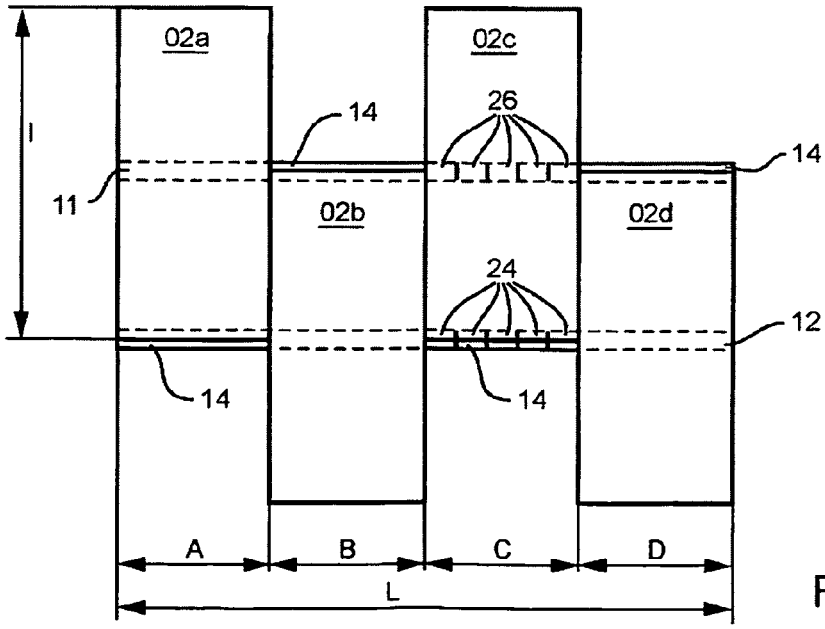

A cylinder 01 of a rotary printing press, and in particular a cylinder 01 of a rotary offset printing press, is represented by way of example in FIG. 1. This cylinder 01 can be configured and used as a forme cylinder 01*a* or as a transfer cylinder 01*b*, as seen in FIG. 2, and can be covered, in a circumferential direction of the cylinder 01, with one dressing, for example, and axially, i.e. with respect to a cylinder length L, with four dressings 02*a*, 02*b*, 02*c*, 02*d*, for example, so that four upright or horizontal dressings are located on the cylinder 01, as is seen in FIG. 5.

In connection with the use of cylinder 01 as a forme cylinder, the dressings are preferably configured as plate-shaped printing formes. In connection with the use of cylinder 01 as a transfer cylinder, the dressings are preferably configured as rubber printing blankets that are each applied to a support plate, i.e. the dressings for the transfer cylinder are preferably embodied as a metal backed, rubber surfaced printing blanket.

Figure 2:
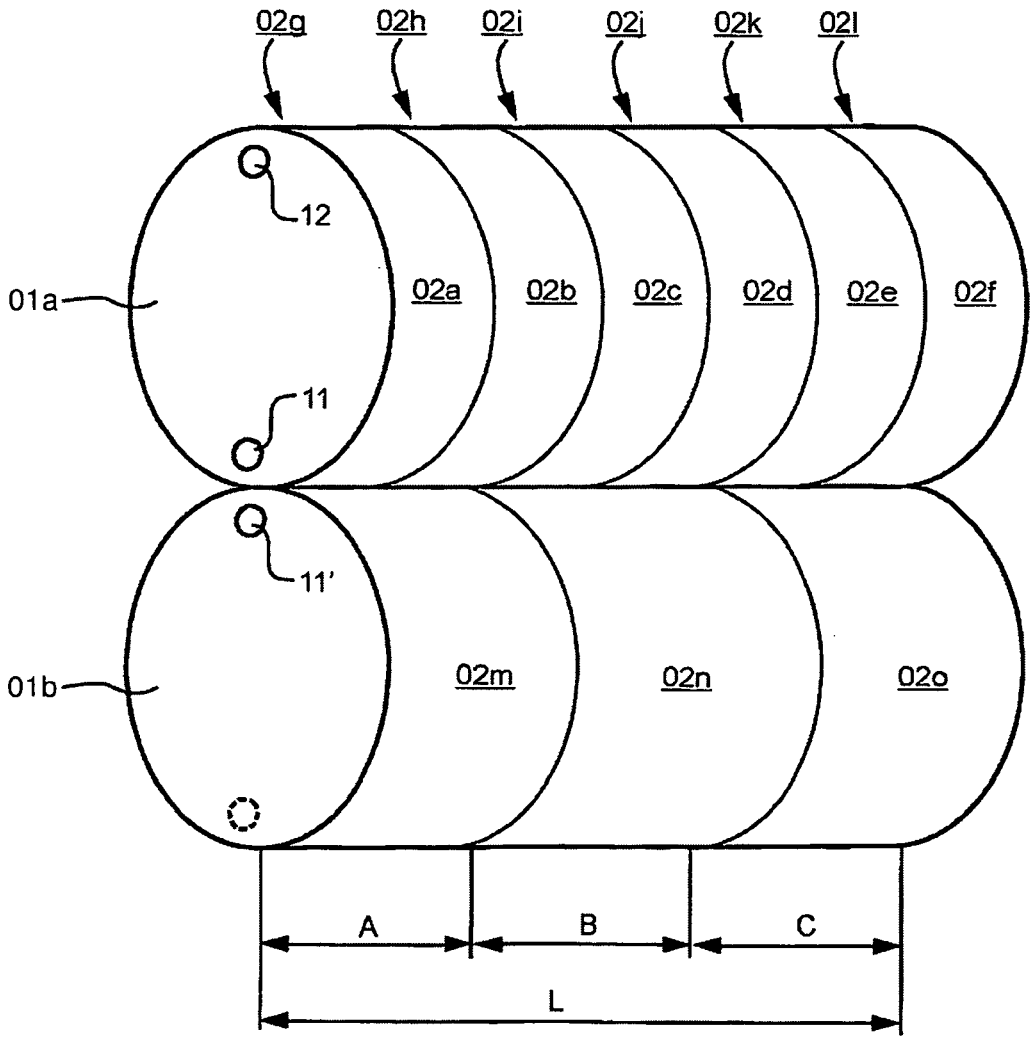
Figure 7:
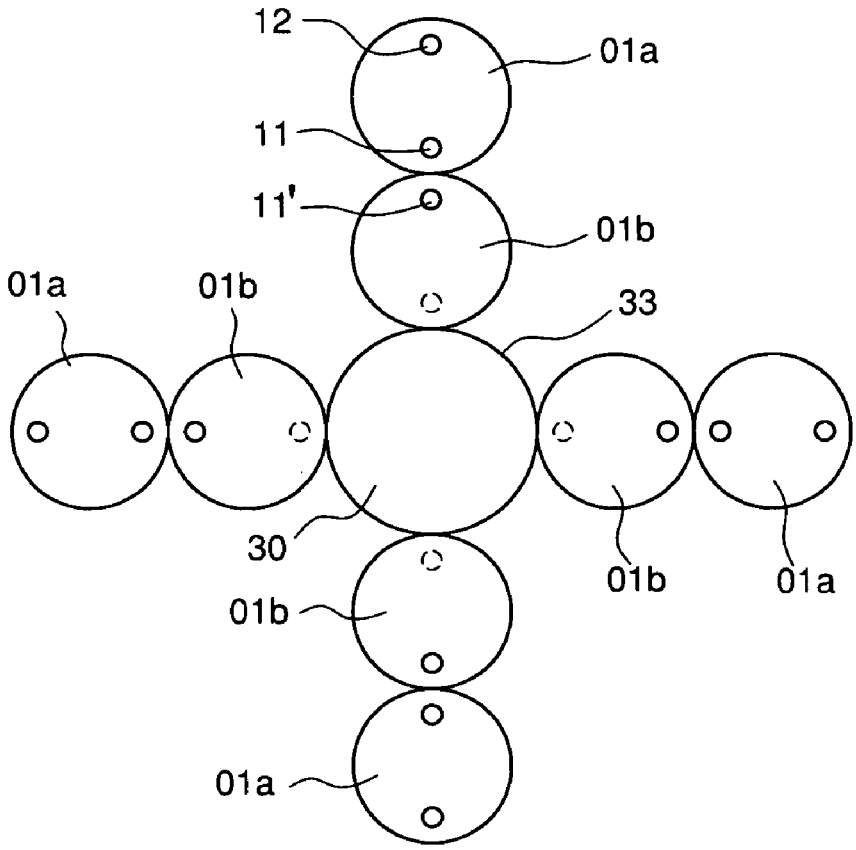

The printing group depicted in FIG. 2 can be configured, for example, as part of a nine-cylinder satellite printing group, wherein four cylinder pairs, each cylinder pair consisting of a forme cylinder 01*a* and of a transfer cylinder 01*b*, are arranged in a frame, preferably in separate cylinder pairs, and positioned diametrically around a common counter-pressure cylinder 30, as shown in FIG. 7, in a preferably identical distribution, so that forces acting when the cylinder pairs are placed against the counter-pressure cylinder are mutually supported. The forme cylinders 01*a* and the transfer cylinders 01*b* each have the characteristics directed to the attainment of the object proposed for the present invention. The counter-pressure cylinder, which is not specifically depicted, preferably has a smooth, i.e. closed, outer shell without openings.

Arrangements of cylinder pairs are advantageous, particular for newspaper printing, as shown in FIG. 2, wherein a forme cylinder 01*a* is covered, in its axial direction, in a first semi-circumferential row with, for example, six plate-shaped printing formes 02*a*, 02*b*, 02*c*, 02*d*, 02*e*, 02*f* and, as only schematically depicted in FIG. 2, with a second semi-circumferential row, on the side of the forme cylinder 01*a* which cannot be seen in the representation of FIG. 2, with a further six plate-shaped printing forms 02*g*, 02*h*, 02*i*, 02*j*, 02*k*, 021, so that the forme cylinder 02*a* has along its length groups of two plate-shaped printing formes one behind the other around its circumference. Six such groups or pairs are shown in FIG. 2. Such a forme cylinder 02*a* rolls off on or against a transfer cylinder 01*b* which, for example, is covered axially with three side-by-side arranged rubber printing blankets 02*m*, 02*n*, 02*o*. Each one of these rubber printing blanket 02*m*, 02*n*, 02*o* essentially extends around the entire circumference of the transfer cylinder 01*b*. In this example depicted in FIG. 2, the rubber printing blankets 02*m*, 02*n*, 02*o* each have twice the width and twice the length of the respective ones of the plate-shaped printing formes 02*a* to 02*i*. The forme cylinder 01*a*, which is, for example, covered with a total of twelve plate-shaped printing formes 02*a* to 02*i*, and the transfer cylinder 01*b* which is, for example, covered by a total of three rubber printing blankets 02*m*, 02*n*, 02*o*, here preferably both have the same geometric dimensions with respect to the lengths L of their barrels and their circumferences. The plate-shaped printing formes 02*a* to 02*i* each have leading and trailing ends 03, 04 which ends are fastened on the forme cylinder 01*a* in two plate end receiving grooves 11, 12, which grooves 11, 12 are offset by 180° about the circumference of cylinder 01*a*, for example. The respective ends 03, 04 of the rubber printing blankets 02*m*, 02*n*, 02*o* are held in at least one groove 11' of the transfer cylinder 01*b*, as seen in FIG. 2. The forme cylinder 01*a* and the transfer cylinder 01*b* are arranged in the printing group in such a way that their respective grooves roll off on each other, as is also shown in FIG. 2. To complete the picture, it should be noted here that the forme cylinder

01*a* can also be covered with dressings which are configured as a panorama printing plate, so that each plate-shaped printing forme contains two print image pages. In this case, the reference symbols 02*a* to 02*i* shown in FIG. 2 for the dressings relate to the print image pages, wherein the print image pages 02*a*, 02*b*, or 02*c*, 02*d*, or 02*e*, 02*f*, or 02*g*, 02*h*, or 02*i*, 02*j*, or 02*k*, 02*l* are respectively both arranged on one panorama printing plate. Each print image page can more typically correspond to a single newspaper page, for example. An arrangement of six such newspaper pages, placed side-by-side in the axial direction of the forme cylinder 01*a*, is advantageous.

If now, as will be described subsequently, dressings are arranged offset with respect to each other in the circumferential direction of the cylinder, in the case where panorama plates are being employed, this means that not the individual print pages, but the panorama plates to be fastened on a shell or circumferential surface 13 of the cylinder 01*a*, each such panorama plate consisting of two print pages, are arranged offset with respect to each other. To make possible such an offset arrangement of dressings, in a cylinder that is configured with two axially extending, circumferentially spaced grooves, the individual panoramic dressings must either each extend completely around the circumference, wherein both ends of the same dressing are fastened in the same groove, and wherein the ends of an adjoining dressing are fastened in the other groove. Alternatively, more than two grooves will be provided in the cylinder, for example four such grooves may be provided and are each arranged offset circumferentially by 90° with respect to each other, so that respectively two dressings can be arranged one behind the other in respect to the cylinder circumference, for example, and wherein the ends of each dressing are fastened in two different grooves, each offset by 180°, and adjoining dressings are fastened in two other grooves which are offset by 90° in respect to the first two grooves.

Figure 3:
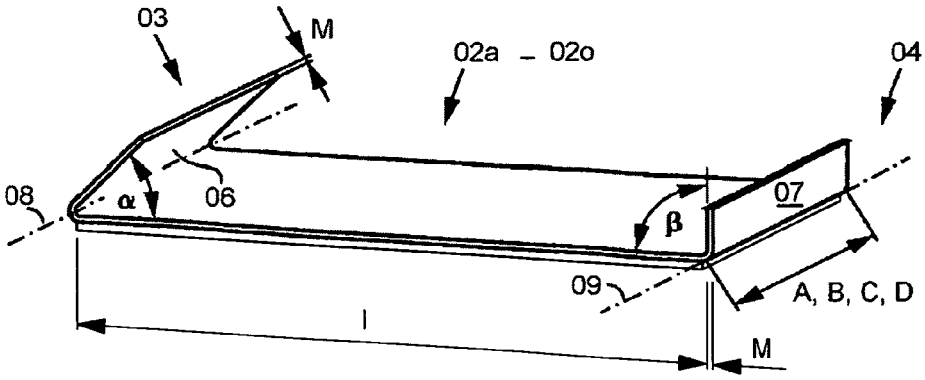

The cylinder 01, 01*a*, 01*b* has a diameter D1 of, for example 160 mm to 340 mm, and preferably of between 280 mm and 300 mm. The axial length L of the barrel of the cylinder 01, 01*a*, 01*b* lies in the range of between 1200 mm and 2400 mm, for example, and preferably of between 1900 mm and 2300 mm, as depicted in FIG. 1. A plate-shaped printing forme, or a support plate for a rubber printing blanket, as seen in FIG. 3, as a rule, consists of a flexible, but an otherwise dimensionally stable material, such as, for example, an aluminum alloy, and has two oppositely located ends 03, 04, which are to be fastened in or on the cylinders 01, 01*a*, 01*b*. The plate ends 03, 04 have a material thickness M of, for example, between 0.2 mm to 0.4 mm, and preferably of 0.3 mm. To form suitable plate end suspension legs 06, 07, each of these plate ends 03, 04 is angled off about a bending line 08, 09, and with respect to a plane of the extended length l of the dressings 02*a* to 02*o*, at an angle α, β of between 40° and 140°, and preferably of 45°, 90° or 135°, as seen in FIG. 3. If only a single dressing 02*m* to 02*o* has been applied, in the circumferential direction of the cylinder 01*b*, the length l of the dressing 02*m* to 02*o* approximately corresponds to the length of the circumference of the cylinder 01*b*.

Figure 4:
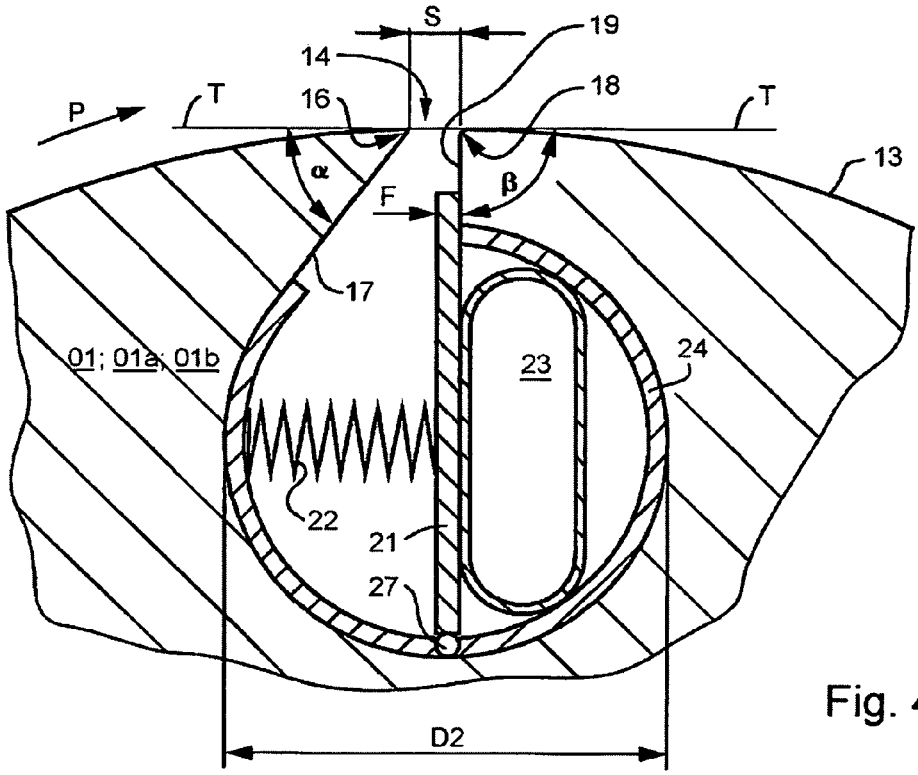

In the preferred embodiment of the present invention, which is represented in FIG. 1, and on which the following explanation of the invention is based, without being limited to this embodiment, a first groove 11 and a second groove 12 are provided in the cylinder 01, wherein both grooves 11, 12 extend continuously in the direction of the length L of the cylinder 01. These two grooves 11, 12 are arranged offset with respect to each other in the direction of the circumference of the cylinder 01, for example are offset at a distance defined by an arc of a circle extending over 180°. To avoid an error in balance of the cylinder 01, which is rotating in the printing group, it is advantageous to arrange the grooves 11, 12 in an equidistant manner about the cylinder 01, i.e. at identical distances from each other. A variation of the arrangement of the present invention, with continuous grooves as represented in FIG. 1, consists in that at least one of the grooves 11, 12 only extends over a part of the entire length L of the cylinders 01. This partial section having a partial groove need not necessarily be arranged at the edge of the circumferential shell 13 of the cylinder 01. Instead, it can also be located between the ends of the cylinder 01 along the interior length of the circumferential shell 13 of the cylinder 01. For reasons of manufacturing technology and for practical reasons, however, it is advantageous to connect a partial groove 11, 12 which is extending only over a part of the length L of the cylinder 01, also with an end face of the cylinder 01, so that the non-continuous groove 11, 12 extends under a section of the cylinder circumference which is closed toward the circumferential shell of the cylinder. If, in the example of a 6/2 forme cylinder 01*a*, such as is represented in FIG. 2, the grooves 11, 12 have an opening 14, as seen in FIGS. 4 and 5, leading to the grooves 11, 12 in the circumferential shell 13, for example in the interior section B, in which the dressings 02*c*, 02*d*, 02*i*, 02*j* are fastened, the grooves 11, 12 can pass either through the section A or C to a front end or end face of the forme cylinder 01*a*. In this case, the grooves 11, 12 are configured as blind bores, which are open at a front or end face of the cylinder 01*a*, 01*b*, and are provided, for example, for mounting a holding device for the dressings, and which extend over one or two adjoining sections A, B, C of the cylinder 01*a*, 01*b*. The mentioned sections A, B, C will be discussed in greater detail in what follows. The width of each of the sections A, B, C, extending in the axial direction of the cylinder 01*a*, 01*b* is preferably defined by the width of the corresponding one of the dressings 02*m*, 02*n*, 02*o* on the transfer cylinder 01*b*.

Both grooves 11, 12 are embodied in the interior of the cylinder 01 at a radial depth "a" of, for example from 4 mm to 10 mm, and preferably of 6 mm, under the shell 13 of the latter in the form of a preferably circular bore through the cylinder 01, and each groove 11, 12 has a diameter of, for example from 25 mm to 50 mm, and preferably of 30 mm. The ratio of the diameters D1, D2 of the cylinder 01 and of the groove 11, 12 therefor is preferably 10:1. If the cross-sectional shape of the grooves 11, 12 is not circular, a ratio of the cross-sectional surfaces of the cylinder 01 and of one of the grooves 11, 12 is preferably 100:1, so that the cross-sectional surface of the grooves 11, 12 is comparatively small in respect to that of the cylinder 01.

In the configuration represented in FIG. 1, both grooves 11, 12 have been divided, in their longitudinal direction, in as many sections A, B, C, D as there are dressings 02*a*, 02*b*, 02*c*, 02*d* which can be arranged side-by-side on the shell 13 of the cylinder 01. The division of the shell 13 into sections corresponds to that of the grooves 11, 12. In some of their sections A, B, C, D, the grooves 11, 12 each may have a narrow, slit-shaped opening 14 extending to the circumferential shell 13 of the cylinder 01, as shown in FIG. 4. It is advantageous if, with respect to the same section A, B, C, D, a groove 11, that is provided with an opening 14, alternates, in the circumferential direction of the cylinder 01, with a groove 12 which is closed toward the shell 13 of the cylinder 11. In this way, an alternating arrangement of openings 14 in the sections A, B, C, D, in relation to the grooves 11, 12 results in the circumferential direction, as well as in the axial direction of the cylinder 01.

A slit width S of the opening 14 is less than 5 mm and preferably lies within the range of 1 mm to 3 mm, as is also shown in FIG. 4.

As can be seen in FIG. 5, in this preferred embodiment of the present invention, the number of the sections A, B, C, D, which are arranged side-by-side in the longitudinal direction in each groove 11, 12 and which are provided with an opening 14, corresponds to one half of the dressings 02*a*, 02*b*, 02*c*, 02*d*, which are arranged circumferentially offset, in respect to each other, over the length L of the cylinder 01. If the shell 13 of the cylinder 01 is covered with more than one side-by-side dressing in the circumferential direction, more than two grooves or partial areas of grooves, each distanced on a defined arc of a circle, are provided, and complex cover arrangements result on the shell 13 of the cylinder 01 because of the larger number of dressings.

In this depicted embodiment, for the sake of simplicity, the number of the dressings 02*a*, 02*b*, 02*c*, 02*d* and of the sections A, B, C, D was selected as being four each, and wherein each cylinder section A, B, C, D has ¼ the length L of the cylinder 01. As indicated in FIG. 5, in a developed representation of the shell 13 of the cylinder 01, all of the four dressings 02*a*, 02*b*, 02*c*, 02*d* positioned on the shell 13 of the cylinder 01, are arranged side-by-side in the axial direction, and the two axially spaced dressings 2*b* and 02*d* are arranged offset, with respect to the two axially spaced dressings 2*a* and 2*c* in such a way that these dressings 02*b* and 02*d* cover the sections B and D of the groove 12, while the dressings 2*a* and 2*c* cover the sections A and C of the groove 11. The groove 11 has an opening 14 to the circumferential shell 13 of the cylinder 01 only in sections B and D, while the groove 12 has an appropriate openings 14 to the circumferential shell in each of the sections A and C. In this example, the dressings 02*a*, 02*b*, 02*c*, 02*d* each enclose the entire circumference of the cylinder 01. Therefore both of the ends 03, 04 of the dressings 02*a*, 02*c* are fastened in the same groove 12, while both of the ends 03, 04 of the dressings 02*b*, 02*d* are fastened in the other groove 11. Thus, each dressing 02*a*, 02*b*, 02*c*, 02*d* covers one of the two grooves 11, 12 in each section A, B, C, D, while it is fastened with its two ends 03, 04 in the other one of the two grooves 11, 12. In this embodiment, each section with an opening 14 adjoins a section that is closed toward the shell 13 of the cylinder 01 with respect to a line that is extending obliquely through all cylinder sections A, B, C, D and on the shell 13 of the cylinder 01, parallel with a groove 11, 12, and whose position is predetermined by the position of a groove 11, 12. The openings 14 cut into the shell 13 of the cylinder 01 are aligned with each other along this line.

The suspension legs 06, 07 formed at the ends 03, 04 of each dressings 02*a* to 02*o* are inserted into the respective opening 14. It is advantageous to suspend one suspension leg 06 of each dressings 02*a* to 02*o* positively connected with a first wall 17 of the opening 14, as seen in FIG. 4, wherein this first wall 17 extends from an outer or circumferential edge 16 of the opening 14, and which first wall 17 leads, in the production direction P of the cylinder 01, 01*a*, 01*b*, toward the interior of the groove 11', 11, 12. An angle α formed at an end 03 of the dressings 02*a* to 02*o* preferably corresponds to an angle α resulting between this first wall 17 extending toward the interior of the groove 11', 11, 12 and an imagined tangent line T resting on the opening 14, again as depicted in FIG. 5. The other suspension leg 07 of each dressing 02*a* to 02*o* can also be placed against a second wall 19 of the opening 14. This second wall 19 extends from an outer or circumferential edge 18 of the opening 14, which trails the edge 16 in the production direction P of the cylinder 01, 01*a*, 01*b* toward the interior of the groove 11', 11, 12. Again, an angle β formed on an end 04 of the dressing 02*a* to 02*o* advantageously corresponds to an angle β which results between this second wall 19 extending toward the interior of the groove 11', 11, 12 and an imagined tangent line T resting on the opening 14, as depicted in FIG. 3. and in FIG. 4.

As represented in FIG. 4, a holding device is provided for fastening the dressings 02*a* to 02*o* on the circumferential shell 13 of the cylinder 01, 01*a*, 01*b* in those sections A, B, C, D of the groove 11', 11, 12, which have an opening 14 toward the circumferential shell 13. The holding device consists, for example, of at least a holding means 21, in the form of, for example, a clamping element 21 and of a spring element 22. The suspension leg 07, shown in FIG. 03 at the trailing end 04 of the dressings 02*a* to 02*o*, and which is suspended in the opening 14, is preferably placed against the second wall 19 of the opening 14 and is pressed against this second wall 19 by the clamping element 21 with a force F which is exerted by the spring element 22 on the clamping element 21. An actuating device 23 is provided in the groove 11', 11, 12 for use in releasing the clamping element 21 which actuating device 23, when actuated, counteracts the force F exerted by the spring element 22 on the clamping element 21 and pivots the clamping element 21 away from the second wall 19 of the opening 14.

Figure 6:
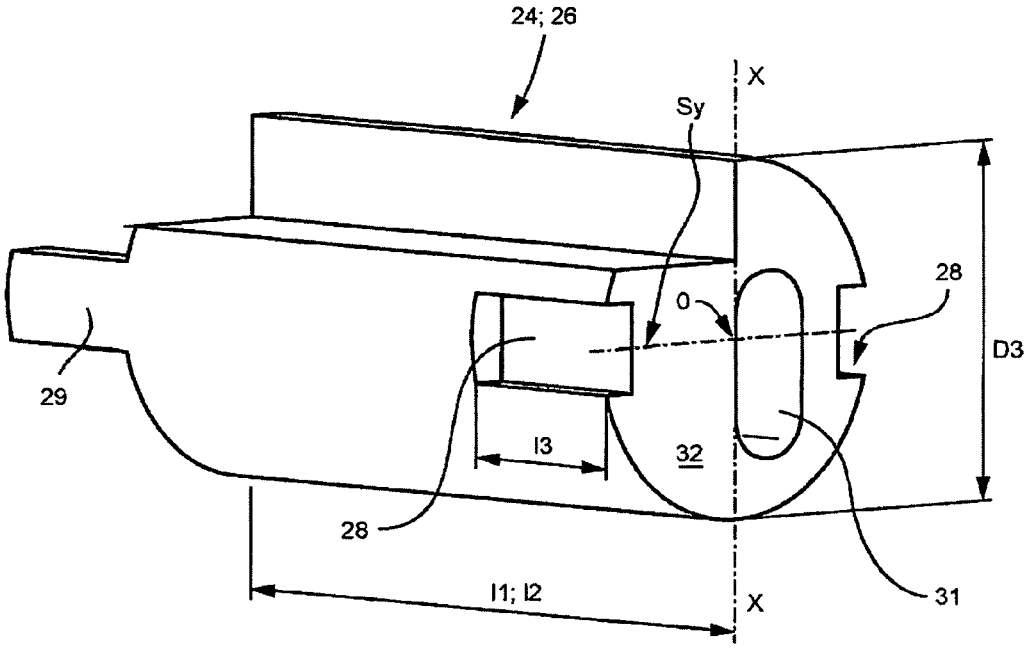

To facilitate easier mounting of the above-described holding device in the groove 11', 11, 12, the holding device, which preferably consists of a clamping element 21 and a spring element 22, is arranged in a base body 24. This base body 24 is preferably embodied substantially in the form of a cylindrical hollow body, whose exterior diameter D3 is slightly less than a diameter D2 of a groove 11', 11, 12, and which base body 24 is supported in the groove 11'; 11, 12 by its shape, and wherein the clamping element 21 is pivotably seated in the interior of, or on the bottom 27 of this base body 24. It is advantageous to combine the support of the base body 24 in the groove 11', 11, 12 with a securing device to counteract any torsion of the base body 24. For example, a stop may be formed on the base body 24, which stop is supported, for example, in the groove 11', 11, 12, or against one of the walls 17, 19 extending to the edges 16, 18 of the opening 14. Due to the considerable length of the sections A, B, C, D, each of which varies, in its size, as a function of the length L of the barrel of the respective cylinder 01, 01*a*, 01*b*, and to easier matching to each position required for them, the base body 24 required for each section A, B, C, D is configured not in one piece, but instead the base body 24 is produced in the form of a partial element, which is short in comparison with the lengths of the sections A, B, C, D, of a length l1. Several identical base bodies 24 are then lined up in the groove 11', 11, 12 for the required length of the sections A, B, C, D. Each base body 24 can be provided, at its front end, with a groove-and-tongue connection 28, 29, or with a plug connection to facilitate positive connection. The length l1 of the base body 24, produced as a partial element, can be between 30 mm and 100 mm, for example, and preferably is 60 mm, as seen in FIG. 6.

In the sections A, B, C, D of the cylinder 01, in which no holding device for fastening a suspension leg 06, 07 of one of the dressings 02*a* to 02*o* is needed, typically in the sections A, B, C, D without an opening 14, the introduction of a base body 24 provided with a holding device into the groove 11', 11, 12 is neither required nor efficient. Filler elements 26, as shown in FIG. 6, are provided for these sections A, B, C, D, and whose outer contours can be similar to the outer contours of the base bodies 24. However, the filler elements 26 do not have a holding device in their interior and are therefore more cost-effective. The filler elements 26 are also preferably embodied as comparatively short partial elements, with respect to the length of the sections A, B, C, D, and of a length l2. The length l2, which is typically the same as a length l1 of the base bodies 24, lies between 30 mm and 100 mm, and can preferably be 60 mm. In this way, groups of approximately five to six base bodies 24 or five to six filler elements 26 are preferably arranged in each section A, B, C, D of a groove 11', 11, 12, and wherein these groups are also arranged in an alternating manner.

It is advantageous to configure the filler elements 26 in such a way that they can be shortened in a simple processing step, such as, for example, by cutting or sawing, to any desired length. The base bodies 24, as well as the filler elements 26, are preferably made of a plastic material in the form of an injection-molded element, or of another suitable material, which is easy to work. It is intended to position lined-up filler elements 26 in the grooves 11, 12 of all those sections A, B, C, D of cylinder 01 which are closed, i.e. in grooves 11, 12 which have no opening 14 toward the shell 13 of the cylinder 01, 01*a*, 01*b*. To accomplish the connection of individual filler elements 26 with each other, or to connect respectively first or last filler elements 26, in a row of several filler elements 26, with a base body 24 arranged in the same groove 11, 12, the filler elements 26 can have the same groove-and-tongue connection 28, 29, or plug connection, at their end faces 32 as are provided on the base bodies 24. To keep the filler element 26 functional with respect to its connectability with other filler elements 26 or with other base bodies 24, following a shortening of its length l2, the groove 28, which is cut into each filler element 26 and of a length l3, extends over a large portion of the overall length l2 of the filler element 26. The groove length l3 can be up to 70% of the overall length l2.

A hose, which can be preferably charged with a pressure medium, such as, for example, compressed air, and which can advantageously be placed into the groove 11', 11, 12 continuously from one end face of the cylinder 01, 01*a*, 01*b* to the other cylinder end face, is provided as the actuating device 23 for the holding device in the base bodies 24. The hose, which forms the actuating device 23, is preferably placed in a location where a clamping element 21 must be actuated. Thus, the actuating device 23 for the holding device can preferably be actuated by remote control, in particular pneumatically, so that the holding device changes from a closed operating position, in which it holds at least one end 03, 04 of one of the dressings 02*a* to 02*f*, 02*g* to 02*m*, 02*n*, 02*o*, as shown in FIG. 4 into an open operating position.

It is advantageous to also configure the filler elements 26 as substantially cylindrical hollow bodies. With this configuration, the base bodies 24, as well as the filler elements 26, have a through-hole 31, through which the hose 23 can be conducted in a line-up of the base elements 24 and the filler elements 26 in the same groove 11, 12. If the through-hole 31 is situated off-centered in the base bodies 24 and the filler bodies 26, or is asymmetrically located in respect to a line Sy extending through their respective centers O, and wherein the center O and the line Sy extending through it are located in the same cross-sectional plane X—X, because of its arrangement or shape, the groove-and-tongue connection 28, 29 or the not depicted plug connection can be used for aligning the through-hole 31 of the base bodies 24 as well as of the filler elements 26 flush with each other, as well as with respect to each other. If the base bodies 24 are arranged, each against relative rotation, in the groove 11, 12, a sufficient protection against twisting of the filler elements 26 is also accomplished because of the positive connection of all of the base bodies 24 arranged in the same groove 11, 12. If necessary, the same protection against twisting, as is provided on the base bodies 24, can be formed on the filler elements 26 An actuating device 23, such as the depicted hose, and arranged continuously extending from the one to the other end of the cylinder 01, 01*a*, 01*b* permits the simultaneous and mutual actuation of the holding device in several base bodies 24, which are arranged in the same groove 11', 11, 12. It is advantageous to insure that at least all of the holding devices, which are arranged in the same section of the plural sections A, B, C, D of a groove 11', 11, 12, can be actuated simultaneously together. This embodiment results in holding devices arranged in different sections A, B, C, D to be actuated section-by-section. These holding devices in each section therefore maintain their own open operating position or their own closed operating position independently of each other. It is thus possible to maintain or to release dressings 02*a* to 02*o* in different sections A, B, C, D individually and independently of each other.

In a further preferred embodiment of the present invention, at least the actuating device 23 is configured as a spindle, for example as an eccentric spindle, that is arranged in the groove 11', 11, 12. If necessary, a clamping element 21 can be formed directly on the spindle, or can be connected with it. By application of a torque acting on the spindle from the direction of an end of the cylinder 01*a*, 01*b*, one or several of the holding devices can be actuated in the grooves 11', 11, 12. For example, a spindle can extend from an end face of the cylinder 01*a*, 01*b* in the groove 11', 11, 12 through a section A or C, which, as shown in FIG. 2, is arranged at the edge or end of the cylinder 01, 01*a*, 01*b*, which does not have an opening 14 extending toward the circumferential shell 13 of the respective cylinder 11', 11, 12 and which has a holding device in the section B which, in the respective groove 11', 11, 12 has an opening 14 toward the shell 13 of the cylinder 01*a*, 01*b*. In this section B, the groove 11', 11, 12, that is configured as a blind bore, as well as the actuating device 23, or the spindle, terminate in this groove 11', 11, 12. It can also be provided that in the same groove 11', 11, 12, for example in the sections A and C, individual spindles can be inserted, which individual spindles can each be actuated from the end face of the cylinder 01*a*, 01*b*. These sections A, C each have an opening 14 toward the shell 13 of the cylinder 01*a*, 01*b*. Neither an opening 14 nor a groove 11', 11, 12, or an actuating device 23, or a spindle, are provided in section B. In case of a cylinder 01, 01*a*, 01*b* with more than three sections A, B, C in its axial direction, a groove 11', 11, 12, which is embodied as a blind bore, can also tunnel underneath a section B, C, which does not lie directly at an edge of the cylinder 01, 01*a*, 01*b* and which is closed toward the shell 13.

Regardless of how the groove 11', or the grooves 11, 12, in the cylinders 01, 01*a*, 01*b* are structured, whether they extend continuously from one to the other end face of the cylinder 01, 01*a*, 01*b*, or whether they are embodied as partial elements in the respective sections A, B, C, D, in accordance with the attainment of the object of the present invention, it is sufficient for a cylinder 01, 01*a*, 01*b*, having a circumference U, as well as having a length L, and wherein the shell 13 of the cylinder 01, 01*a*, 01*b* is divided into at least three adjoining sections A, B, C over the length L, that the shell 13 in each of at least three sections A, B, C has a slit-shaped opening 14 and wherein, in relation to the circumference U of the cylinder 01, 01*a*, 01*b*, at least two openings 14 of a section A, B, C, D, are arranged offset with respect to the openings 14 of another section A, B, C, D. In this case, preferably two openings 14, which are arranged in two different sections A, B, C, D, are aligned with each other. Here, every opening 14 opens into at least a partial element of a groove 11', 11, 12 extending underneath the shell 13 of the cylinder 01, 01*a*, 01*b*.

A printing group of a rotary offset printing press, and using a cylinder 01, 01*a*, 01*b* in accordance with the present invention, results, for example, in the printing group having at least one forme cylinder 01*a* rolling off on a transfer cylinder 01*b*, wherein the forme cylinder 01*a* has at least two dressings 02*a* to 02*l* axially, as well as around its circumference U, for example, and the transfer cylinder 1*b* has at least two dressings 02*m* to 02*o* axially, for example, and wherein at least two of the dressings 02*a* to 02*l* arranged along its circumference U are arranged offset with respect to each other. In this case, the forme cylinder 01*a* preferably has at least four dressings 02*a* to 02*l* arranged side-by-side axially, and wherein the at least four dressings 02*a* to 02*l* are arranged offset, in pairs, in the axial direction of the forme cylinder 01*a*. The forme cylinder 01*a* can, in particular, have six dressings 02*a* to 02*l*, which are arranged offset with respect to each other, in pairs, in the axial direction of the forme cylinder 01*a*. In a printing group of this type, the dressings 02*m* to 02*o* of the transfer cylinder 01*b* are preferably as long, measured along the transfer cylinder 01*b* circumference U, as two dressings 02*a* to 02*l* of the forme cylinder 01*a*, measured along that cylinder circumference, so that a forme cylinder 01*a* of double circumference and a single-circumference transfer cylinder 1*b* work together with each other and roll off on each other.

As previously described, it is of advantage to configure this printing group as a 9-cylinder satellite printing unit. In a printing group having cylinders of great length, for example of a length of up to 2400 mm, wherein the printing group has a forme cylinder which preferably prints six newspaper pages side-by-side in its axial direction and also has a transfer cylinder of corresponding length working together with the forme cylinder, there is a considerable tendency, in particular at high rotary speeds, toward interfering cylinder bending fluctuations, which negatively affect the print quality and which are even increased by the groove or channel beat between the forme cylinder and the transfer cylinder. It is therefore advantageous to employ such cylinders of great length particularly in a 9-cylinder satellite printing unit. Every transfer cylinder in such a 9-cylinder satellite printing unit can be supported by a central counter-pressure cylinder. The counter-pressure cylinder is, in turn, supported by a second transfer cylinder, which is arranged diametrically opposite with respect to the first transfer cylinder. Customarily, the counter-pressure cylinder has a smooth closed shell, which closed shell completely supports the transfer cylinder on its surface. This arrangement, together with the groove beat-reducing offset of the center rubber printing blanket with respect to the two outer rubber printing blankets, assures a high degree of reduced vibrations, of quiet running, and therefore of high print quality. Thus, the advantage to be gained by the present invention consists, in particular, in that it is possible to configure a vibration-reduced printing group even in connection with cylinders of great length, and in which steps taken in connection with the cylinder can be advantageously realized by manufacturing technology.

While preferred embodiments of a cylinder pair and cylinders of a printing unit of a rotary offset printing machine, in accordance with the present invention, have been set forth fully and completely hereinabove, it will be apparent to one of skill in the art that changes in, for example, drives for the cylinders, a source of air under pressure, and the like could be made without departing from the true spirit and scope of the present invention which is accordingly to be limited only by the appended claims.

What is claimed is:

1. A cylinder pair of a printing group of a rotary offset printing press comprising:

a forme cylinder having a forme cylinder axial length in an axial direction of said forme cylinder and a forme cylinder circumferential shell having a forme cylinder circumferential length, said forme cylinder being divided along said forme cylinder axial length into a plurality of forme cylinder sections;

a transfer cylinder having a transfer cylinder axial length in an axial direction of said transfer cylinder and a transfer cylinder circumferential shell having a transfer cylinder circumferential length, said transfer cylinder being divided along said transfer cylinder axial length into a plurality of transfer cylinder sections;

at least one printing forme on each of said forme cylinder sections;

at least one printing blanket on each of said transfer cylinder sections;

a plurality of axially extending grooves beneath said shell surfaces of said forme cylinder and said transfer cylinder;

at least one printing forme end receiving opening for each said printing forme on said forme cylinder shell and terminating in one of said forme cylinder grooves;

at least one printing blanket end receiving opening for each said printing blanket on said transfer cylinder shell and terminating in one of said transfer cylinder grooves, at least one of said forme end receiving openings rolling off on one of said blanket end receiving openings, all of said forme end receiving openings following each other in said axial direction of said forme cylinder being aligned;

at least three said printing blankets aligned side by side axially on said transfer cylinder in said transfer cylinder axial direction, each said printing blanket having a circumferential length of said transfer cylinder circumferential shell;

an axial length of each said printing blanket end receiving opening being equal to said axial length of each said printing blanket, said printing blanket end receiving openings of adjacent ones of said transfer cylinder sections being offset from each other by 180° in said circumferential shell, ones of said blanket end receiving openings spaced apart by alternating ones of said transfer cylinder sections being aligned in said axial direction of said transfer cylinder; and a number of said printing formes aligned axially on said forme cylinder is at least equal to said number of printing blankets aligned axially on said blanket cylinder, each said printing forme having a circumferential length of half said forme cylinder circumferential length, an axial length of each said printing blanket being a whole number multiple of an axial length of each said printing forme.

2. The cylinder pair of claim 1 wherein the axial length of each printing blanket is twice the axial length of each printing forme.

3. The cylinder pair of claim 1 wherein each said printing forme is of equal axial length.

4. The cylinder pair of claim 1 wherein each of said printing blankets is of equal axial length.

5. The cylinder pair of claim 1 further including a dimensionally stable support plate for each said printing blanket.

6. The cylinder pair of claim 1 wherein at least one of said axially extending grooves is a blind bore open at an end of a respective one of said forme cylinder and said transfer cylinder.

7. The cylinder pair of claim 1 wherein each said axially extending groove is a blind bore open at an end of a respective one of said forme cylinder and said transfer cylinder.

8. The cylinder pair of claim 1 further including at least one holding device in each said axially extending groove and located beneath one of said end receiving openings.

9. The cylinder pair of claim 1 further including a filler element in said axially extending grooves not located beneath one of said end receiving openings.

10. The cylinder pair of claim 1 further including a counter-pressure cylinder in contact with said transfer cylinder.

11. The cylinder pair of claim 10 wherein said counter-pressure cylinder has a closed shell.

12. The cylinder pair of claim 10 further including four said cylinder pairs and arranged around said counter-pressure cylinder and forming a nine-cylinder printing group.

13. The cylinder pair of claim 1 wherein each said end receiving opening has a slit width of less than 5 mm.

14. The cylinder pair of claim 1 wherein each said cylinder has an axial length of between 1200 mm and 2400 mm.

15. The cylinder pair of claim 1 wherein each said cylinder has a diameter of between 160 mm and 340 mm.

16. The cylinder pair of claim 1 wherein each said groove is arranged beneath said shell at a distance between 4 mm and 10 mm.

17. The cylinder pair of claim 1 wherein each said groove is a circular bore.

18. The cylinder pair of claim 17 wherein each said groove has a diameter of between 25 mm and 50 mm.

19. The cylinder pair of claim 1 wherein each said printing forme has at least one print image location.

20. The cylinder pair of claim 1 wherein each said printing forme is a panorama printing plate.

* * * * *